US005668100A

United States Patent [19]

Schmid et al.

[11] Patent Number: 5,668,100

[45] Date of Patent: Sep. 16, 1997

[54] DETERGENT MIXTURES AND DETERGENTS OR CLEANING FORMULATIONS WITH IMPROVED DISSOLVING PROPERTIES

[75] Inventors: Karl Schmid, Mettmann; Andreas Syldath, Duesseldorf; Ditmar Kischkel, Monheim; Thomas Krohnen, Duesseldorf; Michael Neuss, Cologne; Hubert Pawelczyk, Duesseldorf; Monika Boecker, Leichlingen; Hermann-Josef Welling, Viersen, all of Germany

[73] Assignee: Henkel Kommanditgesellschaft auf Aktien, Duesseldorf, Germany

[21] Appl. No.: 619,493

[22] PCT Filed: Sep. 14, 1994

[86] PCT No.: PCT/EP94/03077

§ 371 Date: Mar. 25, 1996

§ 102(e) Date: Mar. 25, 1996

[87] PCT Pub. No.: WO95/08616

PCT Pub. Date: Mar. 30, 1995

[30] Foreign Application Priority Data

Sep. 23, 1993 [DE] Germany ..... 43 32 373.1
Feb. 3, 1994 [DE] Germany ..... 44 03 323.0

[51] Int. Cl.[6] ..... C11D 17/06

[52] U.S. Cl. ..... 510/446; 510/357; 510/358; 510/443; 510/452

[58] Field of Search ..... 510/235, 276, 510/358, 357, 340, 452, 443, 413, 414, 446

[56] References Cited

U.S. PATENT DOCUMENTS

| | | | |
|---|---|---|---|
| 5,415,806 | 5/1995 | Pipe et al. | 252/174.21 |
| 5,478,580 | 12/1995 | Swift et al. | 252/547 |
| 5,516,447 | 5/1996 | Bauer et al. | 252/85.1 |

FOREIGN PATENT DOCUMENTS

| | | |
|---|---|---|
| 0164514 | 3/1985 | European Pat. Off. . |
| 0208534 | 7/1986 | European Pat. Off. . |
| 0208534 | 1/1987 | European Pat. Off. . |
| 0342917 | 11/1989 | European Pat. Off. . |
| 0525239 | 2/1993 | European Pat. Off. . |
| 0544492 | 6/1993 | European Pat. Off. . |
| 2124526 | 2/1980 | Germany . |
| 4124701 | 7/1986 | Germany . |
| 4221381 | 2/1994 | Germany . |
| 4242185 | 6/1994 | Germany . |
| 43 00 772 | 7/1994 | Germany . |
| 4319578 | 12/1994 | Germany . |
| WO9102047 | 2/1991 | WIPO . |
| WO9209676 | 6/1992 | WIPO . |
| WO9214809 | 9/1992 | WIPO . |
| WO9413771 | 1/1993 | WIPO . |
| WO9302176 | 2/1993 | WIPO . |
| WO9308251 | 4/1993 | WIPO . |
| WO9315180 | 8/1993 | WIPO . |
| WO9316110 | 8/1993 | WIPO . |
| WO9409111 | 4/1994 | WIPO . |
| WO9302176 | 2/1996 | WIPO . |

OTHER PUBLICATIONS

Fette, Seifen, Anstrichmittel 71, 381 (1969).

*Primary Examiner*—Paul Lieberman
*Assistant Examiner*—Nicholas Ogden
*Attorney, Agent, or Firm*—Ernest G. Szoke; Wayne C. Jaeschke; Real J. Grandmaison

[57] ABSTRACT

A substantially water-free detergent mixture comprising a) alkyl or alkenyl sulfates corresponding to formula (I):

$$R_1OSO_3X \quad (I)$$

in which $R_1$ is a linear or branched aliphatic hydrocarbon radical containing 16 to 18 carbon atoms and X is an alkali metal or alkaline earth metal, ammonium, alkylammonium, alkanolammonium or glucammonium, b) alkyl or alkenyl sulfates corresponding to formula (II):

$$R_2OSO_3X \quad (II)$$

in which $R_2$ is a linear or branched aliphatic hydrocarbon radical containing 12 to 14 carbon atoms and X is an alkali metal or alkaline earth metal, ammonium, alkylammonium, alkanolammonium or glucammonium, wherein components a) and b) are present in a ratio by weight of 90:10 to 70:30, and c) a hydrophobic structure breaker corresponding to formula (III):

$$R_4O(CH_2CH_2O)_nH \quad (III)$$

in which $R_4$ is a linear or branched alkyl or alkenyl radical containing 12 to 18 carbon atoms and n is 0 or a number of 1 to 5.

20 Claims, No Drawings

DETERGENT MIXTURES AND DETERGENTS OR CLEANING FORMULATIONS WITH IMPROVED DISSOLVING PROPERTIES

BACKGROUND OF THE INVENTION

1. Field of the Invention

This invention relates to water-free detergent mixtures containing long-chain and relatively short-chain alkyl sulfates in selected mixing ratios and hydrophobic structure breakers and to the use of these mixtures for the production of solid detergents.

Anionic surfactants, more particularly alkyl sulfates or fatty alcohol sulfates, are important constituents of laundry detergents, dishwashing detergents and cleaning formulations. In contrast to nonionic surfactants, which exhibit inverse solubility behavior and which, by virtue of hydrogen bridge bonds, show better solubility in cold water than in warm water, anionic surfactants show conventional behavior, i.e. their solubility increases more or less linearly with the temperature until the solubility product is reached. However, for technical applications, for example with regard to dispensing behavior during the washing process, there is a need for anionic surfactants which show adequate solubility even in cold water.

In the past, there has been no shortage of attempts to improve the problem posed by the inadequate solubility of anionic surfactants, more particularly alkyl benzene sulfonates, fatty alcohol sulfates and α-methyl ester sulfonates, in cold water. These attempts have mostly been based on two concepts, namely:

a) the use of hydrotropes and b) surface enlargement of the surfactant particles.

Short-chain alkylaryl sulfonates, for example toluene, xylene or cumene sulfonate, are undoubtedly among the most well-known hydrotropes. They are suitable, for example, as solubilizers for anionic and nonionic surfactants in the production of liquid detergents. The improvement in solubility is probably attributable to advantageous mixed micelle formation, cf. the review by H. Stache in Fette, Seifen, Anstrichmittel 71, 381 (1969). However, the improvement in cold water solubility, especially in the case of fatty alcohol sulfates, is normally achieved by adding surfactants with high HLB values, for example highly ethoxylated polyglycol ethers (tallow alcohol·40 EO adduct) or the like, to them as hydrotropes. Unfortunately, the dissolving rates obtainable in this way, especially in the case of fatty alcohol sulfates, are unsatisfactory for a number of technical applications.

2. Discussion of Related Art

According to the teaching of DE-A-41 24 701 (Henkel), solid detergents of high apparent density and improved solubility are obtained by adding polyethylene glycol ethers with molecular weights in the range from 200 to 12,000 and preferably in the range from 200 to 600 to mixtures of anionic and nonionic surfactants and then drying the resulting mixtures and/or converting them into solid form. Example 1 discloses a detergent formulation containing $C_{12-18}$ fatty alcohol sulfate, $C_{12-18}$ fatty alcohol·5 EO and $C_{16-18}$ tallow fatty alcohol·5 EO adduct and - based on the nonionic surfactants - not less than 45% by weight of polyethylene glycol with a molecular weight of around 400 which is extruded and granulated after homogenization. However, the dissolving rate of the solid detergents obtained is not always satisfactory. In addition, the presence of the large quantities of polymer required is undesirable.

EP-A-0 208 534 relates generally to spray-dried detergent compositions which, in addition to anionic surfactants, contain nonionic surfactants, polyacrylates and polyethylene glycol ethers with an average molecular weight in the range from 1,000 to 20,000. According to the teaching of this document, the dispersibility of anionic surfactants can be improved by adding nonionic surfactants, polyethylene glycol ethers (PEG) and polyacrylates to them. The only Example describes a mixture containing alkyl benzene sulfonate and fatty alcohol sulfate to which a $C_{12-13}$ oxoalcohol·6.5 EO adduct, sodium polyacrylate and polyethylene glycol with a molecular weight of around 8,000 are added. The ratio by weight of nonionic surfactant to PEG is 1:1.

DE-A-21 24 526 relates to foam-regulated detergents and cleaning compositions. Example 6 discloses compositions containing tallow alcohol sulfate, alkyl benzene sulfonate and polyethylene glycol with a molecular weight of around 20,000.

Other process developments concerning the production of solid anionic surfactants are merely mentioned in passing at this juncture. For example, solid detergents obtained by treating water-containing alkyl sulfate pastes with soda and zeolites and then extruding the pastes are known from International patent application WO-A-92/09676 (Henkel). The dissolving rate of the solids is not discussed in this document.

International patent application WO-A-91/02047 describes a process for the production of high-density washing- or cleaning-active extrudates in which a solid free-flowing compound containing a plasticizer and/or lubricant is extruded under pressure to form strands and, after leaving the multiple-bore extrusion die, the strands are cut to the predetermined granule size by means of a cutting unit. Full particulars of the extrusion process can be found in International patent applications WO-A-93/02176 and WO-A-94/09111. In one preferred embodiment of the invention, the compound is preferably delivered continuously to a twin-screw extruder with co-rotating or contra-rotating screws, of which the housing and the extruder/granulation head can be heated to the predetermined extrusion temperature. Under the shearing effect of the screws, the compound is compressed under pressure (preferably under a pressure of at least 25 bar or, where the throughputs are extremely high, under an even lower pressure, depending on the machine used), plasticized, extruded in the form of strands through the multiple-bore extrusion die in the extrusion head and, finally, the extrudate is size-reduced by a rotating cutting blade, preferably to substantially spherical or cylindrical granules. The bore diameter of the multiple-bore extrusion die and the length to which the strands are cut are adapted to the dimensions selected for the granules. In this embodiment, it is possible to produce granules with a particle size determined substantially uniformly in advance, the absolute particle sizes being adaptable to the application envisaged. Particle diameters of up to at most 0.8 cm are preferred. Important embodiments are aimed at the production of uniform granules in the millimeter range, for example in the range from 0.5 to 5 mm and, more particularly, in the range from about 0.8 to 3 mm. In one important embodiment, the length-to-diameter ratio of the primary granules formed is in the range from about 1:1 to about 3:1. In another preferred embodiment, the still plastic and moist primary granules are subjected to another shaping step in which any edges present in the crude extrudate are rounded off so that spherical to substantially spherical extrudates are ultimately obtained. If desired, small quantities of a dry powder, for example zeolite powders, such as zeolite NaA powder, may be applied in this stage. This shaping step may be carried out in conventional spheronizing machines. It is important to ensure that only small quantities of fine particles are formed in this stage. The extrudates are then preferably subjected to a drying step, for example in a fluidized bed dryer. The extruded granules, which may also contain peroxy bleaching agents, for example perborate monohydrate, may be dried without any loss of active oxygen at feed air temperatures of 80° to 150° C. Alternatively, it is even possible to carry out the drying step immediately after extrusion of the crude extrudate and hence before any optional final shaping step in a spheronizer. The extrudates may then be blended with other constituents of detergents or cleaning formulations.

Now, the problem addressed by the present invention was to make alkyl sulfates available in such a form that, after mixing with other detergent ingredients and mechanical compaction, they would give detergents or cleaning formulations which would be readily soluble even in cold water and of which the production would be free from the disadvantages mentioned above.

DESCRIPTION OF THE INVENTION

In a first embodiment, therefore, the present invention relates to a detergent mixture containing a) alkyl and/or alkenyl sulfates corresponding to formula (I):

$$R_1OSO_3X \quad (I)$$

in which $R_1$ is a linear or branched aliphatic hydrocarbon radical containing 16 to 18 carbon atoms and X is an alkali metal or alkaline earth metal, ammonium, alkylammonium, alkanolammonium or glucammonium, b) alkyl and/or alkenyl sulfates corresponding to formula (II):

$$R_2OSO_3X \quad (II)$$

in which $R_2$ is a linear or branched aliphatic hydrocarbon radical containing 12 to 14 carbon atoms and X is as defined above, characterized in that the detergent mixture is substantially water-free and contains components a) and b) in a ratio by weight of 90:10 to 70:30 and c) hydrophobic structure breakers corresponding to formula (III):

$$R_4O(CH_2CH_2O)_nH \quad (III)$$

in which $R_4$ is a linear or branched alkyl and/or alkenyl radical containing 12 to 18 carbon atoms and n is 0 or a number of 1 to 5.

In the context of the present invention, the expression "substantially water-free" means that, although the individual solid ingredients may still contain residues of water from their production, no water is additionally introduced during the production of the detergent mixture according to the invention and the total quantity of water in the detergent mixture should be limited to values of less than 10% by weight and preferably to values of not more than 5% by weight.

In the context of the invention, a "detergent mixture" is always understood to be a mixture of components (I), (II) and (III) unless it is specifically stated that another ingredient is present in the mixture.

The detergent mixtures according to the invention may be blended with other powder-form ingredients of detergents or cleaning formulations and, after mechanical compaction, more particularly extrusion, give solid detergents which have a clearly improved dissolving rate and which have advantages in terms of their dispensing behavior in washing machines.

The invention includes the observation that it is only the combination of various features, namely the use of hydrophobic structure breakers and the mixing of alkyl sulfates differing in their C-chain lengths, which produces a synergistic improvement in dissolving behavior. Another critical feature has proved to be the ratio by weight of the various alkyl sulfates to one another because an improvement in the dissolving rate should not be acquired at the expense of a deterioration in the washing properties.

The alkyl sulfates used (also referred to as fatty alcohol sulfates) are normally prepared by sulfation of alcohols with gaseous sulfur trioxide or chlorosulfonic acid and subsequent neutralization with bases. These alcohols are preferably derived from alcohols of renewable raw materials. Accordingly, the alcohols in question are in particular fatty alcohols which only have even-numbered carbon chain lengths. However, if alcohols of different origin are used, alcohols with odd-numbered carbon chain lengths may also occur. In this case, however, $C_{15}$ alkyl sulfates should not be present on their own, but only in the form of mixtures with other alkyl sulfates corresponding to formula (I) and/or to formula (II). However, its content should preferably not exceed 20% by weight, based on the sum total of alkyl sulfates present. The described ratio of component a) to component b) may be established on the one hand by preparing corresponding mixtures specifically from $C_{12-14}$ alkyl sulfates and $C_{16-18}$ alkyl sulfates. However, it is also possible to use mixtures containing, for example, $C_{12-18}$ alkyl sulfates, i.e. components a) and b) as such, and optionally to establish the described ratio of a) to b) - if it is not already present in the mixture - by addition of the corresponding relatively short-chain or relatively long-chain alkyl sulfates. It is equally possible to prepare various mixtures of, for example, $C_{12-16}$ alkyl sulfate and $C_{16-18}$ alk(en)yl sulfate or $C_{12-18}$ alk(en)yl sulfates with only small percentage contents of relatively short-chain $C_{12-14}$ alkyl sulfates. Accordingly, there are various ways of producing the corresponding detergent mixtures. The detergent mixtures may also contain other alk(en)yl sulfates containing less than 12 carbon atoms or more than 18 carbon atoms. In this case, too, odd-numbered and branched alcohols may also be used, depending on the origin of the alcohol source. In a particularly preferred embodiment, however, the alcohols are linear and saturated and, in the same way as the fatty alcohols, are obtained from renewable raw materials. From the performance point of view, however, alkyl sulfates containing less than 12 carbon atoms are present in quantities of not more than 20% by weight and preferably in quantities of not more than 10% by weight while alk(en)yl sulfates containing more than 18 carbon atoms are similarly present in quantities of not more than 20% by weight and preferably in quantities of not more than 10% by weight. The quantities mentioned are all based on the sum total of alk(en)yl sulfates present. Of particular advantage in this regard are alk(en)yl sulfate mixtures which contain at most 5% by weight of alkyl sulfates containing less than 12 carbon atoms, but are preferably free from such alkyl sulfates, and which contain at most 5% by weight of alk(en)yl sulfates containing more than 18 carbon atoms, but are preferably free from such alk(en)yl sulfates. The quantities mentioned are again based on the sum total of alk(en)yl sulfates present.

Typical examples of alkyl sulfates which make up component a) are cetyl sulfate, stearyl sulfate and oleyl sulfate and technical mixtures thereof based on $C_{16-18}$ tallow alcohol or synthetic mixtures of comparable chain length. Typical examples of alkyl sulfates which make up component b)

are lauryl sulfate and myristyl sulfate and technical mixtures thereof based on $C_{12-14}$ coconut oil fatty alcohol or palm kernel oil fatty alcohol or synthetic mixtures of comparable chain length.

The hydrophobic structure breakers are fatty alcohols or adducts thereof with a few moles of ethylene oxide. Typical examples are lauryl alcohol, myristyl alcohol, cetyl alcohol, palmitoleyl alcohol, stearyl alcohol, isostearyl alcohol, oleyl alcohol, linolenyl alcohol and technical mixtures thereof and adducts thereof with 1 to 5 moles of ethylene oxide. The alkoxylation products may have both a conventional homolog distribution and, in particular, a narrow-range homolog distribution.

From the performance point of view, preferred hydrophobic structure breakers corresponding to formula (III) are those in which $R_4$ is a linear alkyl radical containing 12 to 14 carbon atoms and n=0 or a number of 1 to 3. It is of particular advantage to use $C_{12-14}$ cocofatty alcohol or its 2 EO adduct. The substantially water-free detergent mixtures may contain the hydrophobic structure breakers in quantities of 1 to 50% by weight and preferably 5 to 20% by weight, based on the mixtures.

In some preferred embodiments of the invention, it has proved to be of advantage to use a non-ethoxylated fatty alcohol containing 12 to 18 carbon atoms as the hydrophobic structure breaker. Typical examples of corresponding fatty alcohols are - as mentioned above - lauryl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol or technical mixtures thereof, more particularly $C_{12-14}$, $C_{16-18}$ or $C_{12-18}$ fatty alcohol mixtures. These also include the unsulfonated components from the production of the alk(en)yl sulfates of a) and b). The quantity of unsulfonated components in the industrially produced alk(en)yl sulfate mixture, which normally contains other constituents, especially inorganic salts, in addition to the alk(en)yl sulfates and the unsulfonated components, is preferably not more than 4.5% by weight. More particularly, the unsulfonated component should be less than 3% by weight and is advantageously less than 2% by weight, based on the industrially produced alk(en)yl sulfate mixture.

Extensive tests conducted by applicants have shown that, in contrast to the fatty alcohol additionally used, the effect of the unsulfonated component (US) present in the alkyl sulfates, i.e. the free fatty alcohol, during subsequent processing to solid detergents or cleaning formulations, especially in the case of the particularly preferred extrudates, can be that the dissolving rate of the detergent or cleaning formulation decreases again with increasing US content for a constant ratio of component a) to component b). However, this effect can be corrected by increasing the percentage content of the relatively short-chain component b) within the indicated limits.

In one preferred embodiment, therefore, the invention relates to water-free detergent mixtures which contain components a) and b) in a ratio by weight of 90:10 to 80:20 and in which the US contents in components a) and b) total less than 2% by weight, based on components a) and b).

In another advantageous embodiment, the invention relates to water-free detergent mixtures which contain components a) and b) in a ratio by weight of 70:30 to 75:25 and in which the US contents in components a) and b) total less than 4.5% by weight, based on components a) and b).

If other advantageous mixtures are not illustrated by the Examples contained in the experimental section, the expert may vary the parameters "US content" and "ratio of a) to b)" of his own volition on the basis of the present teaching without having to become involved in any inventive activity.

Purified alk(en)yl sulfate mixtures which do not contain any unsulfonated components may be used and may even be particularly preferred for the reasons explained above. Corresponding purified alk(en)yl sulfate mixtures may be obtained, for example, by drying with superheated steam. The water-free detergent mixtures used in accordance with the invention contain the non-ethoxylated alcohols preferably in quantities of 1 to 50% by weight and more preferably in quantities of up to 20% by weight, based on the detergent mixtures. In a particularly preferred embodiment, 1 to 20% by weight and advantageously 2 to 15% by weight of linear alcohols containing up to 16 carbon atoms and, more particularly, 2 to 12% by weight of fatty alcohols containing 12 and/or 14 carbon atoms may be present in the detergent mixtures used in accordance with the invention in addition to any unsulfonated components already present from the industrial production process. In one preferred embodiment of the invention, the content of $C_{18}$ alcohol is no more than 2% by weight and, in particular, no more than 1.5% by weight, based on the detergent mixture. In another preferred embodiment of the invention, the content of alcohols containing more than 15 carbon atoms is no more than 10% by weight, preferably no more than 5% by weight and, more preferably, no more than 3% by weight, based on the detergent mixture.

To produce readily soluble alkyl sulfates, the surfactant particles have to be structured which requires the incorporation and homogeneous distribution of the optionally compacted structure breaker. This can be done in various ways.

In one particularly simple embodiment of the process, the alkyl sulfates (components a and b) are introduced in powder form and thoroughly mixed with the necessary quantity of the optionally compacted structure breaker. This may advantageously be done in such machines as, for example, Eirich mixers or Lödige blade mixers or, in particular, Schugi spray mixers, in which the anionic surfactant is initially introduced into the mixing compartment and the hydrophobic structure breaker is optionally sprayed together with a polymeric compacting agent. In addition, drying of the anionic surfactant pastes and mixing may be carried out simultaneously in a fluidized-bed dryer. Dry, readily soluble powders are obtained and may be subsequently blended with other typical, solid powder-form detergent additives, for example spray-dried compounds, and processed for example to detergent extrudates.

The present invention also relates to a process for the production of water-free detergent mixtures in which mixtures of alkyl and/or alkenyl sulfates corresponding to formulae (I) and (II) are impregnated with the hydrophobic structure breakers (III).

If the structure breakers to be used are liquid under normal conditions, the question arises as to how the structure breaker can be made to remain in and permanently structure the alkyl sulfate particles without "bleeding out". Various studies which applicants have conducted in this regard have surprisingly shown that the dry particles of anionic surfactants have an astonishing absorption capacity for the liquid structure breakers mentioned. For example, 5 to 10% by weight and, in individual cases, even up to 15% by weight of the liquid structure breakers can be processed with the anionic surfactants to form a solid readily soluble product without the structure breaker gradually bleeding out and the dissolving rate decreasing in the event of prolonged storage.

However, it has been found that bleeding can be reliably prevented by the addition of so-called polymeric compacting agents, particularly when relatively large quantities (above 10% by weight) of the structure breakers are to be added to the anionic surfactants.

Polyethylene glycol ethers (PEG) with an average molecular weight of 12,000 to 100,000 are suitable for this purpose. Typical examples are polyethylene glycols having an average molecular weight of 12,000 to 35,000. The water-free detergent mixtures may contain the polymeric compacting agents in quantities of 1 to 5% by weight and preferably in quantities of 2 to 4% by weight, based on the hydrophobic structure breakers.

The present invention also relates to the use of the substantially water-free detergent mixtures according to the invention for the production of solid detergents or cleaning formulations by standard methods by mixing with other powder-form or granular detergent ingredients or compounds and preferably by subsequent mechanical compaction.

Other detergent additives suitable for this purpose are, for example, other surfactants and builders, such as zeolites, phosphates, polycarboxylates, waterglass, soda, sodium sulfate and the like. If desired, components b) may even be added to a spray-dried compound and the resulting mixture incorporated in the water-free mixture of components a) and b).

In one preferred embodiment of the invention, the alkyl sulfates are mixed in powder form with the optionally compacted structure breakers and the resulting mixture is homogenized and compacted in a screw extruder. The mixture is extruded through a multiple-bore extrusion die, resulting in the formation of strands which can be mechanically size-reduced in known manner to form extrudates or needles of the required shape and size Extrudates of this type have a particularly high dissolving rate and exhibit very favorable dispensing behavior in washing machines.

It has been found that the use of certain detergent mixtures according to the invention of the described type leads to particularly favorable performance properties of the extrudates in the production of extruded detergents or cleaning formulations.

In another embodiment, therefore, the invention relates to the use of the above-described detergent mixtures for the production of detergents or cleaning formulations, a non-ethoxylated alcohol containing 12 to 18 carbon atoms (n=0) being used as the hydrophobic structure breaker c) and the percentage content of $C_{18}$ alcohol not exceeding 3% by weight, based on the detergent mixture of (I), (II) and (III).

In another particularly preferred embodiment, the invention relates to extruded detergents or cleaning formulations containing substantially water-free detergent mixtures which contain a) alkyl and/or alkenyl sulfates corresponding to formula (I):

$$R_1OSO_3X \quad (I)$$

in which $R_1$ is a linear or branched aliphatic hydrocarbon radical containing 16 to 18 carbon atoms and X is an alkali metal or alkaline earth metal, ammonium, alkylammonium or glucammonium, b) alkyl and/or alkenyl sulfates corresponding to formula (II):

$$R_2OSO_3X \quad (II)$$

in which $R_2$ is a linear or branched aliphatic hydrocarbon radical containing 12 to 14 carbon atoms and X is as defined above, and c) hydrophobic structure breakers corresponding to formula (III):

$$R_4O(CH_2CH_2O)_nH \quad (III)$$

in which $R_4$ is a linear or branched alkyl and/or alkenyl radical containing 12 to 18 carbon atoms and n is 0 or a number of 1 to 5, with the proviso that they contain components a) and b) in a ratio by weight of 90:10 to 70:30, the hydrophobic structure breaker c) being a non-ethoxylated alcohol containing 12 to 18 carbon atoms and the percentage content of $C_{18}$ alcohol not exceeding 3% by weight, based on the detergent mixture.

Where they are used in accordance with the invention for the production of washing- or cleaning-active extrudates, the detergent mixtures containing non-ethoxylated alcohols as hydrophobic structure breakers surprisingly show advantages over detergent mixtures containing ethoxylated alcohols, particularly those with low degrees of ethoxylation, such as a $C_{12-14}$ fatty alcohol·3 EO or a $C_{12}$_fatty alcohol·5 EO or 7 EO, as hydrophobic structure breakers. In view of the high viscosities and yield points of mixtures of alkyl sulfates with the above-mentioned distribution of component a) and component b) with short-chain and non-ethoxylated fatty alcohols, such as lauryl alcohol for example, by comparison with corresponding mixtures containing fatty alcohols with low degrees of ethoxylation as hydrophobic structure breakers, the expert would be correct in assuming that the use of mixtures with non-ethoxylated fatty alcohols during the extrusion process carried out under high pressures would result in the formation of extrudates of which the surface would be "tackified" by poorly soluble surfactant gels and which would thus show unfavorable dissolving properties and low dissolving rates. It was all the more surprising to find that the detergent mixtures preferably used in accordance with the invention lead to extrudates which exhibit extremely favorable dissolving behavior.

Suitable polymeric compacting agents which may optionally be used are, in particular, polyethylene glycol ethers having an average molecular weight of 12,000 to 100,000. The substantially water-free mixtures of the various alk(en)yl sulfates, fatty alcohols and polymeric compacting agents may contain the latter, for example, in quantities of 1 to 5% by weight and preferably in quantities of 2 to 4% by weight, based on the mixture as a whole.

These detergent mixtures are then used in the production of the extruded detergents or cleaning compositions where they are used as a component of the solid free-flowing compounds. The extruded detergents or cleaning formulations and the special process for the production are another subject of the present invention. The compound is extruded under a pressure of, preferably, at least 25 bar to form strands, as described for example in International patent application WO-A-91/02047. The compound has such a consistency that, immediately after leaving a multiple-bore extrusion die, the strand can be cut to the predetermined granule size by means of a cutting unit. The extrudates may contain all the usual ingredients of detergents or cleaning formulations, including ethoxylated alcohols, more particularly ethoxylated fatty alcohols, which - as nonionic surfactants - are used in addition to and separately from the detergent mixtures. Besides the nonionic surfactants mentioned, the typical ingredients in question include above all other surfactants, such as anionic, cationic, zwitterionic or amphoteric surfactants and other nonionic surfactants.

The detergents or cleaning formulations or rather the extrudates contain, for example, the known alkyl benzene sulfonates, olefin sulfonates, alkane sulfonates, sulfonated fatty acid glycerol esters and/or α-sulfofatty acid methyl esters of their corresponding disalts as anionic surfactants. However, the extrudates preferably contain no more than 15% by weight and, in particular, no more than 10% by weight of these additional anionic surfactants. Extrudates containing only the alk(en)yl sulfates mentioned, more particularly alkyl sulfates, as anionic surfactants are most particularly preferred. However, the extrudates may additionally contain soaps in quantities of 0.5 to 5% by weight. Suitable soaps are saturated fatty acid soaps, such as the salts of lauric acid, myristic acid, palmitic acid or stearic acid, and soap mixtures derived in particular from natural fatty acids, for example coconut oil, palm kernel oil or tallow fatty acids. Unsaturated fatty acid soaps derived, for example, from oleic acid may also be present, although they should make up no more than 50% by weight of the soaps.

The anionic surfactants and soaps may be present in the form of their sodium, potassium or ammonium salts and in the form of soluble salts of organic bases, such as mono-, di- or triethanolamine. The anionic surfactants are preferably present in the form of their sodium or potassium salts, more particularly in the form of their sodium salts. The content of anionic surfactants, including the alkyl sulfates and soaps, in the detergents or cleaning formulations, including the extrudates, is generally between 5 and 40% by weight.

The nonionic surfactants used are preferably alkoxylated, advantageously ethoxylated, more particularly primary, alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates with linear radicals of alcohols of native origin containing 12 to 18 carbon atoms, for example of coconut oil, palm kernel oil, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12}$—alcohol containing 3 EO and $C_{12-18}$ alcohol containing 5 EO. The degrees of ethoxylation mentioned represent statistical mean values which, for a particular product, may be either a whole number or a broken number. Preferred alcohol ethoxylates have a narrow homolog distribution (narrow-range ethoxylates, NRE). Fatty alcohols containing more than 12 EO, for example tallow fatty alcohol containing 14 EO, 25 EO, 30 EO or 40 EO, may be used in addition to these nonionic surfactants.

Other suitable nonionic surfactants are alkyl glycosides corresponding to the general formula $RO(G)_x$, where R is a primary linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10, preferably assuming a value of 1.2 to 1.4.

Other suitable surfactants are polyhydroxyfatty acid amides corresponding to formula (IV):

$$R^5-CO-\overset{\overset{\displaystyle R^6}{|}}{N}-[Z] \qquad \text{(IV)}$$

in which $R^5CO$ is an aliphatic acyl radical containing 6 to 22 carbon atoms, $R^6$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups.

The percentage content of nonionic surfactants in the detergents or cleaning formulations is generally from 2 to 25% by weight.

In detergent mixtures containing anionic and nonionic surfactants, particularly where they are to be used in extrudates, the ratio by weight of anionic surfactant to nonionic surfactant is preferably of the order of 15:1 to 1:1 and more preferably of the order of 10:1 to 1:1.5.

Suitable inorganic builders are any of the builders hitherto typically used, including in particular zeolites, crystalline layer silicates and even phosphates providing their use is not objectionable on ecological grounds. Their content may normally be in the range from 10 to 60% by weight. The finely crystalline, synthetic zeolite containing bound water used is preferably zeolite NaA of detergent quality. However, zeolite NaX and zeolite P and mixtures of A, X and/or P are also suitable. The zeolite may be used in the form of a spray-dried powder or even in the form of an undried stabilized suspension still moist from its production. Where the zeolite is used in the form of a suspension, it may contain small quantities of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have an average particle size of less than 10 μm (volume distribution, as measured by the Coulter Counter method) and preferably contain 18 to 22% by weight and more preferably 20 to 22% by weight of bound water.

Suitable substitutes or partial substitutes for phosphates and zeolites are crystalline layer-form sodium silicates corresponding to the general formula $NaMSi_zO_{2z+1}\cdot yH_2O$, where M is sodium or hydrogen, z is a number of 1.9 to 4 and y is a number of 0 to 20, z preferably assuming a value of 2, 3 or 4. Corresponding crystalline layer silicates are described, for example, in European patent application EP-A-0 164 514. Preferred crystalline layer silicates corresponding to the above general formula are those in which M is sodium and z has a value of 2 or 3. Both β- and δ-sodium disilicates $Na_2Si_2O_5\cdot yH_2O$ are particularly preferred.

Useful organic builders are, for example, the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), providing their use is not ecologically unsound, and mixtures thereof. Preferred salts are the salts of polycarboxylic acids, such as citric acid, adipic acid, succinic acid, glutaric acid, tartaric acid, sugar acids and mixtures thereof.

Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and of acrylic acid or methacrylic acid with maleic acid. Copolymers of acrylic acid with maleic acid containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Terpolymers, for example those which contain as monomers salts of acrylic acid and maleic acid and also vinyl alcohol or vinyl alcohol derivatives (P 43 00 772.4) or salts of acrylic acid and 2-alkyl allyl sulfonic acid and sugar derivatives (DE-A-42 21 381), are also particularly preferred.

Other suitable builder systems are the oxidation products of carboxyfunctional polyglucosans and/or water-soluble salts thereof which are described, for example, in International patent application WO-A-93/08251 or of which the production is described, for example, in International patent application WO-A-93/16110.

In addition, the detergents/cleaning formulations may also contain components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates.

Other suitable ingredients of the detergents or cleaning formulations are water-soluble inorganic salts, such as bicarbonates, carbonates, amorphous silicates or mixtures thereof. Alkali metal carbonate and amorphous alkali metal silicate, above all sodium silicate with a molar $Na_2O$ to $SiO_2$ ratio of 1:1 to 1:4.5 and preferably 1:2 to 1:3.5, are particularly suitable. The sodium carbonate content of the detergents/cleaning formulations is preferably up to about 20% by weight and advantageously between 5 and 15% by weight. The sodium silicate content of the detergents/cleaning formulations is generally up to 10% by weight and preferably from 2 to 8% by weight.

In one preferred embodiment of the invention, the alkali metal silicates are introduced into the process at least partly in the form of an aqueous solution, for example in the form of a 10 to 45% by weight aqueous waterglass solution.

According to the teaching of earlier German patent application P 43 19 578.4, alkali metal carbonates may also be replaced by sulfur-free amino acids containing 2 to 11 carbon atoms and optionally another carboxyl and/or amino group and/or salts thereof. According to this invention, the alkali metal carbonates are preferably partly or completely replaced by glycine or glycinate.

Among the compounds yielding $H_2O_2$ in water which serve as bleaching agents, sodium perborate tetrahydrate and sodium perborate monohydrate are of particular importance. Other useful bleaching agents are, for example, sodium percarbonate, peroxypyrophosphates, citrate perhydrates and $H_2)_2$-yielding peracidic salts or peracids, such as perbenzoates, peroxophthalates, diperazelaic acid or diperdodecanedioic acid. The content of bleaching agents in the compound is preferably from 5 to 25% by weight and more preferably from 10 to 20% by weight, perborate monohydrate advantageously being used.

To achieve an improved bleaching effect where washing is carried out at temperatures of 60° C. or lower, bleach activators may be incorporated in the preparations. Examples of suitable bleach activators are N-acyl or 0-acyl compounds which form organic peracids with $H_2O_2$, preferably N,N'-tetraacylated diamines, also carboxylic anhydrides and esters of polyols, such as glucose penta-acetate. Other known bleach activators are acetylated mixtures of sorbitol and mannitol as described, for example, in European patent application EP-A-0 525 239. The content of bleach activators in the bleach-containing compounds is in the usual range, preferably from 1 to 10% by weight and more preferably from 3 to 8% by weight. Particularly preferred bleach activators are N,N,N',N'- tetraacetyl ethylenediamine (TAED), 1,5-diacetyl-2,4-dioxohexahydro-1,3,5-triazine (DADHT) and acetylated sorbitol/mannitol mixtures (SORMAN).

Where the detergents are used in machine washing processes, it can be of advantage to add typical foam inhibitors to them. Suitable foam inhibitors are, for example, soaps of natural or synthetic origin with a high percentage content of $C_{18-24}$ fatty acids. Suitable non-surface-active foam inhibitors are, for example, organo-polysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, more particularly silicone- or paraffin-containing foam inhibitors, are preferably fixed to a granular water-soluble or water-dispersible support. Mixtures of paraffins and bis-stearyl ethylenediamides are particularly preferred.

Suitable enzymes are those from the class of proteases, lipases, amylases, cellulases and mixtures thereof. Enzymes obtained from bacterial strains or fungi, such as Bacillus subtilis, Bacillus licheniformis and Streptomyces griseus, are particularly suitable. Proteases of the subtilisin type are preferably used, proteases obtained from Bacillus lentus being particularly suitable. Enzyme mixtures, for example mixtures of protease and amylase or protease and lipase or protease and cellulase or mixtures of cellulase and lipase or mixtures of protease, amylase and lipase or protease, lipase and cellulase, but especially cellulase-containing mixtures, are of particular interest. (Per)oxidases have also proved to be suitable in some cases. The enzymes may be adsorbed to supports and/or encapsulated in shell-forming substances to protect them against premature decomposition. The percentage content of enzymes, enzyme mixtures or enzyme granules may be, for example, of the order of 0.1 to 5% by weight and preferably from 0.1 to around 2% by weight.

Suitable stabilizers, particularly for per compounds and enzymes, are the salts of polyphosphonic acids, more particularly 1-hydroxyethane-1,1-diphosphonic acid (HEDP), diethylenetriamine pentamethylenephosphonic acid (DETPMP) or ethylenediamine tetramethylenephosphonic acid (EDTMP) .

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts, of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

The final detergents or cleaning compositions may consist entirely of extrudates containing the ingredients mentioned above, including the detergent mixtures which are co-extruded as a component of the compound. In another embodiment of the invention, however, the extrudates are produced with other ingredients of detergents or cleaning compositions. The detergents or cleaning compositions may thus appear to consist of a mixture of several different granules of which the extrudates according to the invention represent the principal constituent. Thus, bleach activators, for example N,N'-tetraacylated diamines, such as N,N,N',N'-tetraacetyl ethylenediamine, enzyme-containing enzyme granules, more particularly protease and/or lipase and/or cellulase and/or amylase, mixtures of 2 or 3 enzymes being particularly advantageous, and perfume are preferably added in a subsequent process step. The extrudates may also be treated with other fine-particle drying powders before the incorporation of enzymes and the other ingredients. Examples of suitable drying powders are zeolite, silicas and salts of fatty acids, for example calcium stearate, bleach activator or mixtures of zeolite with one of the other powders mentioned. It has also been found that the foaming behavior of detergents can be positively influenced if the foam inhibitor, for example an organopolysiloxane or a mixture of organopolysiloxanes with microfine, optionally silanized silica and also paraffins, waxes, microcrystalline waxes and mixtures thereof with silanized silica or bis-stearyl ethylenediamide, is at least partly not extruded, but instead subsequently mixed with the extrudate. In this case, it is even possible to cover the surface of the extrudate according to the invention, for example, first with zeolite or with a zeolite-containing mixture and then with a foam inhibitor. These measures enable the dispensing behavior of the extrudates to be further improved. The extrudates produced in accordance with the invention preferably have an apparent density of 600 to 1200 g/l, apparent densities of 700 to 1000 g/l being particularly preferred and those in the range from 750 to 950 g/l being most particularly preferred.

EXAMPLE

Example 1

In a Schugi spray mixer, the hydrophobic structure breaker ($C_{12/14}$ fatty alcohol·2 EO adduct) and optionally the polymeric compacting agent (polyethylene glycol ether, M=12,000) were sprayed onto a corresponding quantity of spray-neutralized fatty alcohol sulfate powder (components a+b). The quantity ratios can be found in Table 1. The water-free detergent mixtures were mixed with other typical detergent ingredients. The homogenized mixture was then extruded first in a screw extruder and then through a multiple bore extrusion die (bore diameter 1.1 mm). The resulting strands were then processed to granules. The composition of the extrudates is set out in Table 1.

The extrudates were subjected to sieve analysis, 5 fractions being obtained:

F1: >1.6 mm

F2: 1.6 to 1.4 mm

F3: 1.4 to 1.25 mm

F4: 1.25 to 1.0 mm

F5: <1.0 mm

FG: full spectrum

Mixtures R1 and R2 correspond to the invention while mixtures C1 to C4 are intended for comparison.

TABLE 1

Extrudate compositions/percentages as % by weight

| Components | C1 % | C2 % | C3 % | C4 % | R1 % | R2 % |
|---|---|---|---|---|---|---|
| $C_{16/18}$ FAS | 18.0 | 20.2 | 15.5 | 18.0 | 15.5 | 15.5 |
| $C_{12/14}$ FAS | — | — | 2.5 | — | 2.5 | 2.5 |
| $C_{12/14}$ FA2 | — | — | — | 2.2 | 2.2 | 2.2 |
| PEG 12000 | — | — | — | — | — | 0.1 |
| $C_{16/18}$ FA40 | 5.0 | 5.0 | 5.0 | 5.0 | 5.0 | 5.0 |
| Zeolite A (water-free) | 35.0 | 35.0 | 35.0 | 35.0 | 35.0 | 35.0 |
| Sodium perborate | 16.0 | 16.0 | 16.0 | 16.0 | 16.0 | 16.0 |
| Waterglass | 7.0 | 7.0 | 7.0 | 7.0 | 7.0 | 7.0 |
| Water and salts | | | ad 100 | | | |

Legend:

$C_{16/18}$ FAS: $C_{16/18}$ fatty alcohol sulfate sodium salt, spray-dried from Sulfopon ® T powder, Henkel KGaA, Düsseldorf, FRG $C_{12/14}$ FAS: $C_{12/14}$ fatty alcohol sulfate sodium salt spray-dried $C_{12/14}$ FA2: $C_{12/14}$ fatty alcohol · 2 EO adduct $C_{16/18}$ FA40: $C_{16/18}$ fatty alcohol · 40 EO adduct PEG 12000: Polyethylene glycol ether (M = 12,000)

To test solubility, quantities of 32 g of extrudate were dissolved or dispersed in 4 1 of water (30° C., 16° d). After 95 s, the solutions or dispersions were filtered off and the residues were dried and weighed out. The results are set out in Table 2:

TABLE 2

Solubility tests/percentages in % by weight

| | Residue in the Fractions | | | | | |
|---|---|---|---|---|---|---|
| Extrudate | F1 % | F2 % | F3 % | F4 % | F5 % | FG % |
| R1 | 29.3 | 24.1 | 13.5 | 8.1 | 0.3 | 16.4 |
| R2 | 29.1 | 23.9 | 12.1 | 7.0 | 0.2 | 15.1 |
| C1 | 57.1 | 55.0 | 49.3 | 42.0 | 14.8 | 55.4 |
| C2 | 60.0 | 59.1 | 51.0 | 44.0 | 14.9 | 59.0 |
| C3 | 45.0 | 39.1 | 39.1 | 30.5 | 10.0 | 31.9 |
| C4 | 45.0 | 39.1 | 32.7 | 25.6 | 8.9 | 20.4 |

Example 2:

Compounds with the compositions shown below were produced in a continuous mixer equipped with a size-reducing unit in the form of a cutter head (chopper) and extruded in accordance with the teaching of International patent application WO-A-91/02047. The extrudate obtained was dried but not further processed. The apparent density of the extrudates according to the invention and the comparison extrudates was between 750 and 900 g/l. The compositions of the extrudates can be found in the following Table. The abbreviations used have the following meanings:

ABS $C_{9-13}$ alkyl benzene sulfonate sodium salt

FAS-M Mixture of Sulfopon T® ($C_{16-18}$ fatty alkyl sulfate, powder-form; a product of Henkel KGaA) and Texapon LS 35® ($C_{12-14}$ fatty alkyl sulfate, liquid; a product of Henkel KGaA) in a ratio by weight of 80:20. The percentage of unsulfonated $C_{16-18}$ fatty alcohol from the Sulfopon T® was 1.45% by weight while the percentage of $C_{12-14}$ fatty alcohol from the Texapon LS 35® was 0.2% by weight, based in each case on the mixture of the two alkyl-sulfate-containing raw materials.

FA Lauryl alcohol

TA40 Tallow fatty alcohol containing 40 ethylene oxide groups (EO)

Nio $C_{12-18}$ fatty alcohol·5 EO and $C_{12-14}$ fatty alcohol·3 EO in a ratio by weight of 4:1

Soap Saturated $C_{12-18}$ fatty acid soap, sodium salt Zeolite Zeolite, expressed as water-free active substance CP5 Sokalan CP5®, copolymer of the salts of acrylic acid and maleic acid; a product of BASF, Federal Republic of Germany Sil3.0 Amorphous sodium silicate with a ratio by weight of $Na_2O$ to $SiO_2$ of 1:3.0

Soda Sodium carbonate

Per Perborate monohydrate

TAED Tetraacetyl ethylenediamine

SIK Silicone oil

Enzyme Protease granules

A 35% by weight aqueous sodium silicate solution (1:3.0) was used as plasticizer and/or lubricant. In M1, a mixture of 9 parts of FAS-M and 1 part of FA was initially prepared in Lödige mixer and was then incorporated in the compound. The extrudates obtained were dried and mixed with TAED and the enzyme.

TABLE 3

Compositions of the extrudate R3 according to the invention and the comparison extrudate C5 (in % by weight)

| | R3 | C5 |
|---|---|---|
| ABS | — | 18 |
| FAS-M | 18 | — |
| FA | 2.2 | — |
| Nio | — | 2.2 |
| Soap | 1 | 1 |
| TA40 | 2.5 | 2.5 |
| Zeolite | 28 | 28 |
| CP5 | 4 | 4 |
| Soda | 5 | 5 |
| Sil3.0 | 2 | 2 |
| Per | 20 | 20 |
| TAED | 6 | 6 |
| SIK | 0.6 | 0.6 |
| Enzyme | 1.2 | 1.2 |
| Water and salts from raw materials | Remainder | Remainder |

Determination of Dispensing Behavior in Washing Machines (Residue in g)

To determine their dispensing behavior, the extrudates were tested in domestic drum-type washing machines with a dispensing draw under a water pressure of 0.5 bar. The test machines were a Miele W918 and Quelle Privileg 1100. Five tests were carried out in each machine. The ten results were averaged out to give the values shown below. To this end, 80 g of the extrudates were introduced into the dispensing compartment per washing process. The tap water with which the extrudates were flushed into the particular machine, which was loaded with 3.5 kg of dry laundry, had a hardness of 16° d. On completion of the dispensing process, the detergent residues from the dispensing draw and the dispensing compartment were separately placed on a watch glass with a rubber wiper and weighed out. 30% moisture was subtracted from the moist residues. The "dry residues" from draw and compartment were added and the average value was formed from the sum and is shown in Table 4 for R3 and C5.

Determination of Residue Behavior in a Simulated Handwashing Test (HW in %)

In a bowl, 32 g of the detergent were predissolved by hand in 4 liters of water (16° d) for 15 seconds at a temperature of 30° C. A Nicki pullover was then immersed three times, squeezed and turned through 90° . After 1 minute, the pullover was removed from the wash liquor and wrung out. The wash liquor was decanted off and the residues were transferred to a sieve and dried at 40° C. The residues are expressed in %. The results are also set out in Table 4.

TABLE 4

Dispensing and residue behavior of the extrudates

| Extrudate | Dispensing Residue in g | Handwashing Residue in % |
|---|---|---|
| R3 | 2.2 | 12.7 |
| C5 | 17.9 | 21.1 |

It is clear from the Table that both the dispensing behavior and the residue behavior of the extrudates in the handwashing test is significantly better in the case of extrudate R3 according to the invention than in the case of Comparison Example C5.

What is claimed is:

1. A substantially water-free detergent mixture compromising a) alkyl or alkenyl sulfates corresponding to formula (I):

$$R_1OSO_3X \quad (I)$$

in which $R_1$ is a linear or branched aliphatic hydrocarbon radical containing 16 to 18 carbon atoms and X is an alkali metal or alkaline earth metal, ammonium, alkylammonium, alkanolammonium or glucammonium, b) alkyl or alkenyl sulfates corresponding to formula (II):

$$R_2OSO_3X \quad (II)$$

in which $R_2$ is a linear or branched aliphatic hydrocarbon radical containing 12 to 14 carbon atoms and X is an alkali metal or alkaline earth metal, ammonium, alkylammonium, alkanolammonium or glucammonium, said components a) and b) being present in a ratio by weight of 90:10 to 70:30, and c) a hydrophobic structure breaker corresponding to formula (III):

$$R_4O(CH_2CH_2O)_nH \quad (III)$$

in which $R_4$ is a linear or branched alkyl or alkenyl radical containing 12 to 18 carbon atoms and n is 0 or a number of 1 to 5.

2. A detergent mixture as in claim 1, wherein said components a) and b) are present in a ratio by weight of 90:10 to 80:20 and the total unsulfonated content of components a) and b) is less than 4.5% by weight, based on the weight of said components a) and b).

3. A detergent mixture as in claim 1 containing compounds corresponding to formula (III) in which $R_4$ is a linear alkyl radical containing 12 to 18 carbon atoms and n is 0 or a number of 1 to 3.

4. A detergent mixture as in claim 1 wherein said hydrophobic structure breaker is present in a quantity of 1 to 50% by weight, based on the weight of said detergent mixture.

5. A detergent mixture as in claim 1 containing polyethylene glycol ethers having an average molecular weight of 12,000 to 100,000 as a polymeric compacting agent.

6. A detergent mixture as in claim 5 wherein said polymeric compacting agent is present in a quantity of 1 to 5% by weight, based on the weight of said hydrophobic structure breaker.

7. The process of producing a high density washing-active extrudate comprising extruding under pressure a substantially water-free solid detergent mixture containing a plasticizer or lubricant wherein said detergent mixture comprises a) alkyl or alkenyl sulfates corresponding to formula (I):

$$R_1OSO_3X \quad (I)$$

in which $R_1$ is a linear or branched aliphatic hydrocarbon radical containing 16 to 18 carbon atoms and X is an alkali metal or alkaline earth metal, ammonium, alkylammonium, alkanolammonium or glucammonium, b) alkyl or alkenyl sulfates corresponding to formula (II):

$$R_2OSO_3X \quad (II)$$

in which $R_2$ is a linear or branched aliphatic hydrocarbon radical containing 12 to 14 carbon atoms and X is as defined above, and c) a hydrophobic structure breaker corresponding formula (III):

$$R_4O(CH_2CH_2O)_nH \quad (III)$$

in which R4 is a linear or branched alkyl or alkenyl radical containing 12 to 18 carbon atoms and n is 0 or a number of 1 to 5, with the proviso that said components a) and b) are present in a ratio by weight of 90:10 to 70:30, to form strands of said extrudate, and cutting said strands of said extrudate to a desired granule size with a cutting unit.

8. A process as in claim 7 wherein said detergent mixture contains less than about 3% by weight of a $C_{18}$ alcohol, based on said detergent mixture.

9. A process as in claim 7 including blending said extrudate with components of detergent or cleaning compositions.

10. A process as in claim 7 wherein said components a) and b) are present in a ratio by weight of 90:10 to 80:20 and the total unsulfonated content of components a) and b) is less than 4.5% by weight, based on the weight of said components a) and b).

11. A process as in claim 7 wherein said detergent mixture contains compounds corresponding to formula (III) in which $R_4$ is a linear alkyl radical containing 12 to 18 carbon atoms and n is 0 or a number of 1 to 3.

12. A process as in claim 7 wherein said hydrophobic structure breaker is present in a quantity of 1 to 50% by weight, based on the weight of said detergent mixture.

13. A process as in claim 7 wherein said detergent mixture contains polyethylene glycol ethers having an average molecular weight of 12,000 to 100,000 as a polymeric compacting agent.

14. A process as in claim 13 wherein said polymeric compacting agent is present in a quantity of 1 to 5% by weight, based on the weight of said hydrophobic structure breaker.

15. A process as in claim 7 wherein said detergent mixture contains alk(en)yl sulfates having less than 12 carbon atoms in a quantity of less than 20% by weight, based on the weight of alk(en)yl sulfates present.

16. A process as in claim 7 wherein said detergent mixture contains alk(en)yl sulfates having more than 18 carbon atoms in a quantity of no more than 20% by weight, based on the weight of alk(en)yl sulfates present.

17. A process as in claim 7 wherein said detergent mixture contains 1 to 20% by weight, based on the detergent mixture, of linear alcohols containing up to 14 carbon atoms in addition to any unsulfonated components present in said alkyl or alkenyl sulfates.

18. The product of claim 7.

19. The product of claim 9.

20. The product of claim 12.

* * * * *